US008967055B1

(12) United States Patent
Morris

(10) Patent No.: US 8,967,055 B1
(45) Date of Patent: Mar. 3, 2015

(54) COLLAPSIBLE PALLET

(71) Applicant: John Thaddeus Morris, Houston, TX (US)

(72) Inventor: John Thaddeus Morris, Houston, TX (US)

( * ) Notice: Subject to any disclaimer, the term of this patent is extended or adjusted under 35 U.S.C. 154(b) by 0 days.

(21) Appl. No.: 13/747,374

(22) Filed: Jan. 22, 2013

Related U.S. Application Data

(60) Provisional application No. 61/593,212, filed on Jan. 31, 2012.

(51) Int. Cl.
*B65D 19/12* (2006.01)
*B65D 19/16* (2006.01)
*B65D 19/00* (2006.01)

(52) U.S. Cl.
CPC .... *B65D 19/0059* (2013.01); *B65D 2519/0087* (2013.01)
USPC ..... 108/56.1

(58) Field of Classification Search
CPC ..... E05D 3/02; E05D 3/04; E05D 5/065; E05D 2700/04; B65D 2519/0087; B65D 2519/00273
USPC ..... 108/51.11, 51.3, 56.1, 56.3; 16/387
See application file for complete search history.

(56) References Cited

U.S. PATENT DOCUMENTS

| | | | | | |
|---|---|---|---|---|---|
| 143,704 | A | * | 10/1873 | Manneck | 16/372 |
| 189,866 | A | * | 4/1877 | Long | 16/389 |
| 504,162 | A | * | 8/1893 | Hoffritz | 16/392 |
| 1,640,525 | A | * | 8/1927 | Belliveau | 16/390 |
| 2,665,096 | A | * | 1/1954 | Vogel | 108/56.1 |
| 3,133,511 | A | * | 5/1964 | Phillips | 108/55.1 |
| 3,153,807 | A | * | 10/1964 | Nyman | 16/390 |
| 3,572,261 | A | * | 3/1971 | Vasiliou | 108/56.1 |
| 3,710,416 | A | * | 1/1973 | Phelps | 16/390 |
| 3,881,220 | A | * | 5/1975 | Kiraly | 16/391 |
| 3,952,672 | A | * | 4/1976 | Gordon et al. | 108/51.3 |
| 4,435,028 | A | * | 3/1984 | Rivkin | 312/258 |
| 5,355,559 | A | * | 10/1994 | Bowers et al. | 16/389 |
| 5,950,546 | A | * | 9/1999 | Brown et al. | 108/56.1 |
| 6,299,011 | B1 | * | 10/2001 | Rosenfeldt | 220/4.29 |

* cited by examiner

*Primary Examiner* — Daniel J Troy
*Assistant Examiner* — Timothy M Ayres
(74) *Attorney, Agent, or Firm* — Plager Schack LLP

(57) ABSTRACT

A collapsible pallet provides for easy storing and shipping, the collapsible pallet comprising a bottom plate mechanically coupled to a pair of side plates with a pair of offset hinges. The side plates are further mechanically coupled to a pair of upper plates by a pair of upper piano hinges. The upper plates are further mechanically coupled to a pair of inner support plates by a pair of inner support piano hinges. A pair of stopper strips that are mechanically coupled to the bottom plate restricts the movement of the inner support plates. In this manner, a user can rotate the side plates and inner support plates parallel to the upper plates and the lower plate causing a collapsed configuration that provides for easy storage and shipping.

5 Claims, 2 Drawing Sheets

COLLAPSIBLE PALLET

CROSS REFERENCE TO RELATED APPLICATIONS

This application claims priority to U.S. Provisional Patent Application 61/593,212 filed on Jan. 31, 2012.

FIELD OF THE INVENTION

This invention relates to pallets, which can be used to ship goods long distances.

BACKGROUND OF THE INVENTION

Prior to the disclosed invention, cargo pallets were used to ship cargo from a shipper to a receiver. Cargo pallets provide a number of advantages including a capacity to hold heavy loads and a capacity to accommodate a fork from a forklift. However, transporting cargo pallets back to a shipper has been expensive because of the large amount of room a relatively small number of pallets require. The present invention solves this problem.

BRIEF SUMMARY OF THE INVENTION

A collapsible pallet provides for easy storing and shipping, the collapsible pallet comprising a bottom plate mechanically coupled to a pair of side plates with a pair of offset hinges. The side plates are further mechanically coupled to a pair of upper plates by a pair of upper piano hinges. The upper plates are further mechanically coupled to a pair of inner support plates by a pair of inner support piano hinges. A pair of stopper strips that are mechanically coupled to the bottom plate restricts the movement of the inner support plates. In this manner, a user can rotate the side plates and inner support plates parallel to the upper plates and the lower plate causing a collapsed configuration that provides for easy storage and shipping.

BRIEF DESCRIPTION OF THE SEVERAL VIEWS OF THE DRAWINGS

Figure 1:
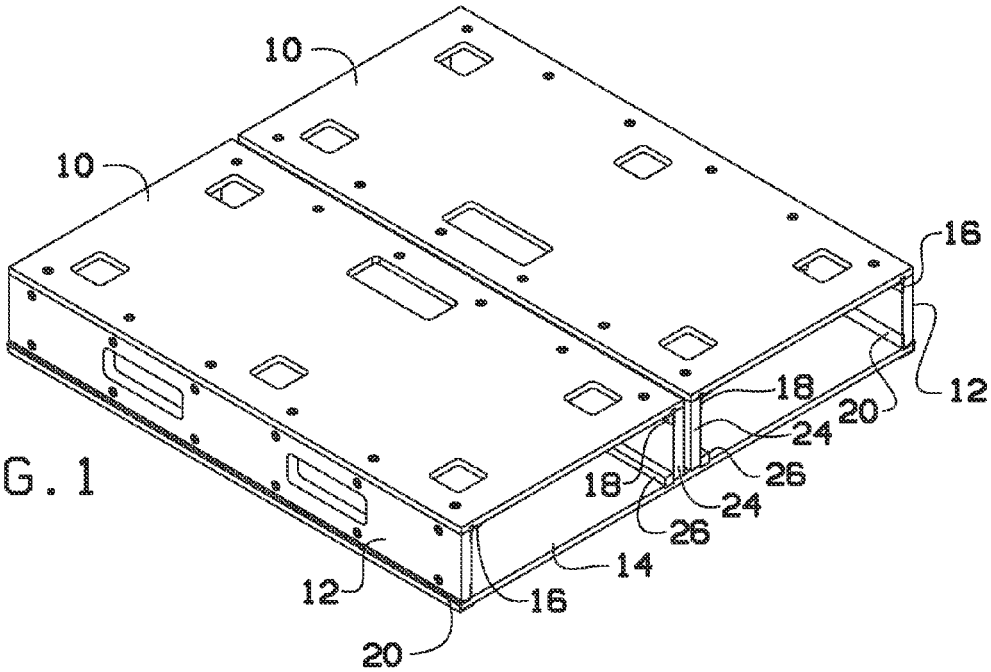

Having thus described the invention in general terms, reference will now be made to the accompanying drawings, which are not necessarily drawn to scale, and wherein:

FIG. 1 is a perspective view of the invention shown in non-collapsed configuration.

Figure 2:
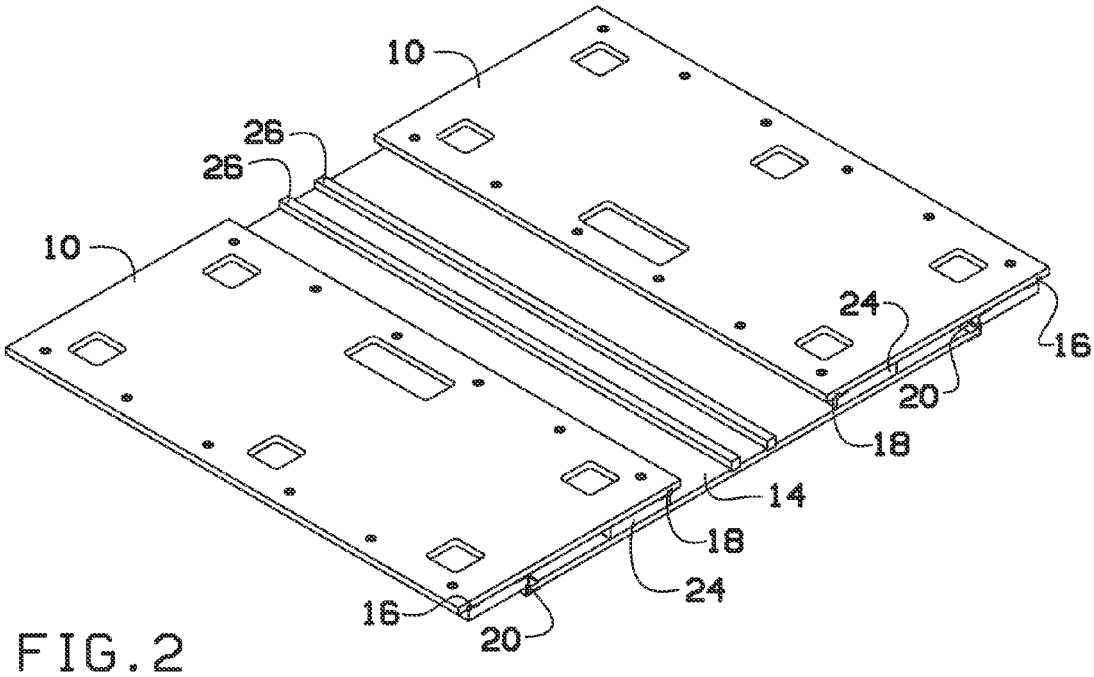

FIG. 2 is a perspective view of the invention shown in collapsed configuration.

Figure 3:
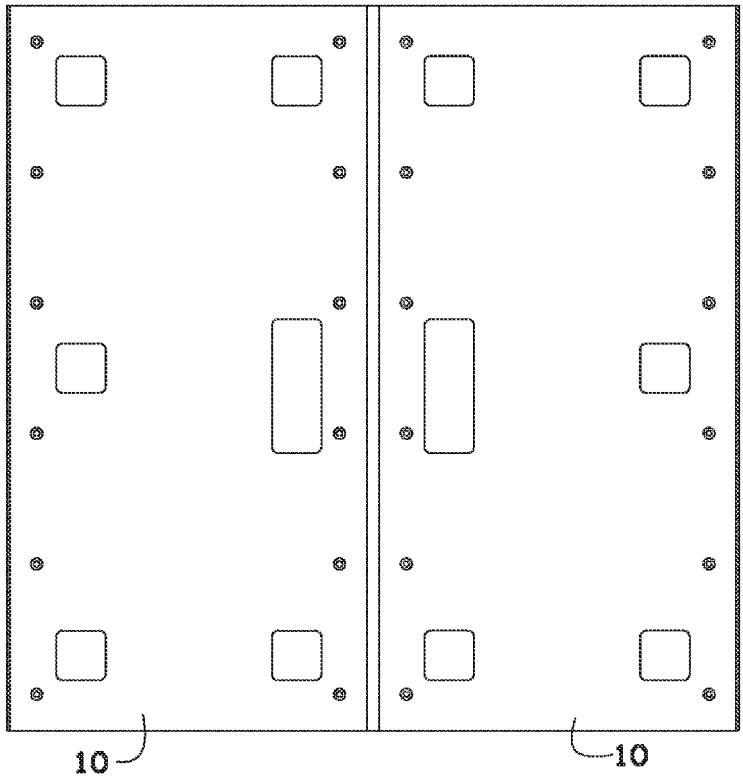

FIG. 3 is a top view of the invention.

Figure 4:
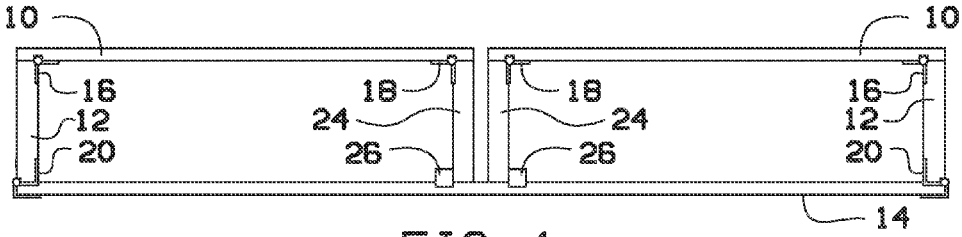

FIG. 4 is a side view of the invention shown in non-collapsed configuration.

Figure 5:
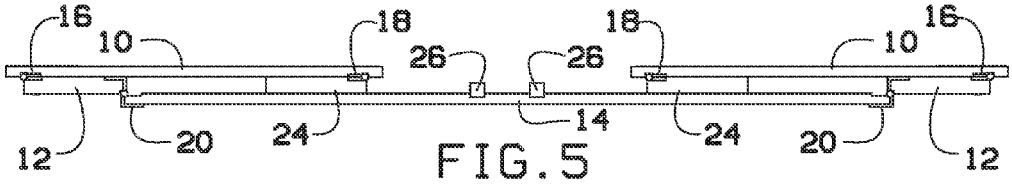

FIG. 5 is a side view of the invention shown in collapsed configuration.

DETAILED DESCRIPTION OF THE INVENTION

Embodiments of the present invention overcome many of the obstacles associated with shipping cargo pallets, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 and FIG. 4 show the invention in a non-collapsed configuration. Bottom plate 14 is mechanically coupled to left side plate 12 by left offset hinge 20. Left side plate 12 is further mechanically coupled to left upper plate 10 by left outer piano hinge 16. Left upper plate 10 is mechanically coupled to left inner support plate 24 by left inner piano hinge 18. Left inner support plate 24 is shown with a bottom side immediately adjacent to bottom plate 14. The movement of left inner support plate 24 is restricted by left stopper strip 26, which is mechanically coupled to bottom plate 14.

In a similar manner, bottom plate 14 is mechanically coupled to right side plate 12 by right offset hinge 20. Right side plate 12 is further mechanically coupled to right upper plate 10 by right outer piano hinge 16. Right upper plate 10 is mechanically coupled to right inner support plate 24 by right inner piano hinge 18. Right inner support plate 24 is shown with a bottom side immediately adjacent to bottom plate 14. The movement of right inner support plate 24 is restricted by right stopper strip 26, which is mechanically coupled to bottom plate 14.

One of the unique features of the present invention is offset hinge 20. Offset hinge 20 comprises a first parallel surface mechanically coupled to a first perpendicular surface. The first perpendicular surface is mechanically coupled to a rod. The rod mechanically couples the first perpendicular surface with a second parallel surface. The second parallel surface is mechanically coupled to a second parallel surface. In this manner, a user can mechanically couple the first parallel surface to bottom plate 14 and the second perpendicular surface to side plate 12. This allows a user to rotate plate 12 parallel to upper plate 10 and lower plate 14. At the same time, inner support plate 24 can be folded parallel to upper plate 10 and bottom plate 14 with piano hinge 18 causing the collapsed configuration shown in FIG. 2 and FIG. 5.

FIG. 1 and FIG. 3 show the location of a plurality of cavities in upper plate 10 and side plate 12. The cavities provide positioning for easy net and strap attachment to ship a wide variety of goods.

Following the teaching in this application will enable a user to ship more than twice as many pallets in a standard sized truck from a receiver to a shipper because of the compact nature of the collapsible pallet in the collapsed configuration. In this matter the collapsible pallet provides for easy storing and shipping.

That which is claimed:

1. A collapsible pallet provides for easy storing and shipping, the collapsible pallet comprising, a bottom plate mechanically coupled to a left side plate by a left offset hinge;

wherein the bottom plate further comprises, at least, a top face, a bottom face, a first side edge and a second side edge;

wherein the left side plate further comprises a left side plate left face, a left side plate right face and a left side plate first side edge;

the left offset hinge further comprises:

a left offset hinge bottom face, perpendicularly attached to a left offset hinge bottom offset segment;

a left offset hinge top face, perpendicularly attached to a left offset hinge top offset segment;

a pin, joining the left offset hinge bottom offset segment with the left offset hinge top offset segment wherein the left offset hinge bottom face is attached to the bottom face, the left offset hinge bottom offset segment is against the first side edge and under the pin, wherein the left offset hinge top face is attached to the left side plate right face; the left offset hinge bottom offset segment is against the left side plate first side edge and above the pin;

wherein folding the left offset hinge top offset segment onto the top face transfers weight of the left side plate onto the bottom plate in order to increase stability the weight is not born by the pin;

wherein the left side plate is further mechanically coupled to a left upper plate by a left outer piano hinge; the left upper plate is mechanically coupled to a left inner support plate by a left inner piano hinge; movement of the left inner support plate is restricted by a left stopper strip, which is mechanically coupled to the bottom plate;

the bottom plate is mechanically coupled to a right side plate by a right offset hinge;

wherein the right side plate further comprises a right side plate left face, a right side plate right face and a right side plate first side edge;

the right offset hinge further comprises:

a right offset hinge bottom face, perpendicularly attached to a right offset hinge bottom offset segment;

a right offset hinge top face, perpendicularly attached to a right offset hinge top offset segment;

a pin, joining the right offset hinge bottom offset segment with the right offset hinge top offset segment wherein the right offset hinge bottom face is attached to the bottom face, the right offset hinge bottom offset segment is against the first side edge and under the pin, wherein the right offset hinge top face is attached to the right side plate right face; the right offset hinge bottom offset segment is against the right side plate first side edge and above the pin;

wherein folding the right offset hinge top offset segment onto the top face transfers weight of the right side plate onto the bottom plate in order to increase stability the weight is not born by the pin;

wherein the right side plate is further mechanically coupled to a right upper plate by a right outer piano hinge; the right upper plate is mechanically coupled to a right inner support plate by a right inner piano hinge; movement of the right inner support plate is restricted by a right stopper strip, which is mechanically coupled to the bottom plate;

in this manner, a user can rotate the left side plate parallel to the left upper plate and the bottom plate; at the same time, the left inner support plate can be folded parallel to the left upper plate and the bottom plate with the left inner piano hinge; likewise, the user can rotate the right side plate parallel to the right upper plate and the bottom plate; at the same time, the right inner support plate can be folded parallel to the right upper plate and the bottom plate with the right inner piano hinge, causing a collapsed configuration which provides for easy storage and shipping.

2. The collapsible pallet of claim 1, the left offset hinge comprises a first parallel surface mechanically coupled to a first perpendicular surface; the first perpendicular surface is mechanically coupled to a rod; the rod mechanically couples the first perpendicular surface with a second parallel surface; the second parallel surface is mechanically coupled to a second perpendicular surface; in this manner, the user can mechanically couple the first parallel surface to the bottom plate and the second perpendicular surface to the left side plate.

3. The collapsible pallet of claim 1, the left upper plate, the right upper plate, the left side plate and the right side plate further comprise a plurality of cavities that provide positioning for easy net and strap attachment to ship a wide variety of goods.

4. The collapsible pallet of claim 1, further comprising:

a first notch on the bottom plate configured to receive the right offset hinge top offset segment.

5. The collapsible pallet of claim 4, further comprising:

a second notch on the bottom plate configured to receive the left offset hinge top offset segment.

* * * * *